US008984810B2

(12) United States Patent
Bortoluzzi et al.

(10) Patent No.: US 8,984,810 B2
(45) Date of Patent: Mar. 24, 2015

(54) DEVICE FOR SLIDING DOOR LEAVES WITH CO-PLANAR CLOSURE, PARTICULARLY FOR FURNITURE AND THE LIKE

(75) Inventors: Guido Bortoluzzi, Belluno (IT); Adriano Girotto, Villorba (IT); Bruno Sponga, Belluno (IT); Rodolfo Dal Castel, Santa Giustina Bellunese (IT)

(73) Assignee: Bortoluzzi Lab S.R.L., Belluno (IT)

( * ) Notice: Subject to any disclaimer, the term of this patent is extended or adjusted under 35 U.S.C. 154(b) by 0 days.

(21) Appl. No.: 14/119,119

(22) PCT Filed: Mar. 16, 2012

(86) PCT No.: PCT/EP2012/054707

§ 371 (c)(1),
(2), (4) Date: Nov. 20, 2013

(87) PCT Pub. No.: WO2012/159784

PCT Pub. Date: Nov. 29, 2012

(65) Prior Publication Data

US 2014/0182212 A1 Jul. 3, 2014

(30) Foreign Application Priority Data

May 23, 2011 (IT) ..... TV2011A0070

(51) Int. Cl.

| | |
|---|---|
| ***E05D 15/06*** | (2006.01) |
| ***E05D 15/10*** | (2006.01) |
| *E05F 1/16* | (2006.01) |
| *E05F 5/00* | (2006.01) |

(52) U.S. Cl.

CPC ..... *E05D 15/0678* (2013.01); *E05D 15/1042* (2013.01); *E05D 2015/1055* (2013.01); *E05D 2015/106* (2013.01); *E05F 1/16* (2013.01); *E05F 5/003* (2013.01); *E05Y 2201/21* (2013.01); *E05Y 2201/412* (2013.01); *E05Y 2201/64* (2013.01); *E05Y 2800/73* (2013.01); *E05Y 2900/20* (2013.01); *E05Y 2201/488* (2013.01); *E05Y 2201/626* (2013.01)

USPC ..... 49/213; 49/209; 312/139

(58) Field of Classification Search

USPC ..... 49/209, 208, 213, 221, 128–130, 410; 312/139, 139.1

See application file for complete search history.

(56) References Cited

U.S. PATENT DOCUMENTS

| | | | | | |
|---|---|---|---|---|---|
| 4,644,690 | A | * | 2/1987 | Caimi | 49/130 |
| 4,704,819 | A | * | 11/1987 | Tutikawa | 49/129 |
| 4,917,446 | A | * | 4/1990 | Mariani | 312/325 |
| 4,949,504 | A | * | 8/1990 | Bortoluzzi | 49/130 |
| 5,253,452 | A | * | 10/1993 | Goldbach | 49/212 |
| 5,287,653 | A | * | 2/1994 | Young | 49/130 |

(Continued)

FOREIGN PATENT DOCUMENTS

| | | | |
|---|---|---|---|
| WO | WO2009043701 | * | 4/2009 |

*Primary Examiner* — Katherine Mitchell
*Assistant Examiner* — Justin Rephann
(74) *Attorney, Agent, or Firm* — Lando & Anastasi, LLP

(57) ABSTRACT

A device for sliding door leaves with co-planar closure, particularly for furniture and the like, including a bracket system for connection to each one of the door leaves and with which a first pair of wheels is associated in a lower region.

The device includes a second pair of wheels which are, together with the first pair of wheels, slideably engaged with the head respectively of a first guide and of a second guide which are T-shaped in cross-section, arc-shaped in plan view and the stem of which protrudes from the top of the piece of furniture.

9 Claims, 7 Drawing Sheets

(56) References Cited

U.S. PATENT DOCUMENTS

| | | | | |
|---|---|---|---|---|
| 5,735,080 | A * | 4/1998 | Pratolongo | 49/209 |
| 6,286,261 | B1 * | 9/2001 | Hackstock | 49/216 |
| 6,336,246 | B1 * | 1/2002 | Giovannetti | 16/87 R |
| 6,497,072 | B2 * | 12/2002 | Fries | 49/209 |
| 6,826,867 | B1 * | 12/2004 | McDonald et al. | 49/213 |
| 6,860,064 | B2 * | 3/2005 | Bakalar | 49/127 |
| 7,426,803 | B2 * | 9/2008 | Fronz et al. | 49/209 |
| 7,647,728 | B2 * | 1/2010 | Bortoluzzi | 49/209 |
| 8,096,629 | B2 * | 1/2012 | Halfon et al. | 312/349 |
| 8,375,645 | B2 * | 2/2013 | Iwauchi et al. | 52/29 |
| 8,438,783 | B2 * | 5/2013 | Giovannetti | 49/130 |
| 2004/0123524 | A1 * | 7/2004 | Batinli et al. | 49/216 |
| 2009/0183434 | A1 * | 7/2009 | Puotunen | 49/209 |
| 2010/0199563 | A1 * | 8/2010 | Bortoluzzi | 49/128 |

* cited by examiner

DEVICE FOR SLIDING DOOR LEAVES WITH CO-PLANAR CLOSURE, PARTICULARLY FOR FURNITURE AND THE LIKE

The present application relates to a device for sliding door leaves with co-planar closure, particularly for furniture and the like.

Nowadays, as an alternative to normal hinged doors, sliding door solutions are known which can be applied both to wardrobes and furniture in general and to door and window frames or to any other application of closing elements that require reduced space in the open position.

Generally these types of doors are constituted by two or more door leaves, each one of which has brackets with rolling means guided by a rail, which is constituted by an upper guide and a lower guide, respectively applied to the floor and to the ceiling of the compartment to be closed, the rail of one door leaf being adjacent and parallel to the rail of the other door leaf.

The sliding of the door leaves in this type of door thus occurs on parallel and adjacent planes which achieve the closure of the compartment by the alignment or partial overlapping of the edges of one door leaf with the edges of the other door leaf and with the mutually opposite edges of both the door leaves against the edges or the jambs of the compartment to be closed.

The unaesthetic quality of sliding doors which when closed are seen arranged on two different planes, although parallel and close together, in particular in furniture where aesthetics assume considerable importance, has led the technique of the field to seek solutions that provide the co-planarity of the two door leaves, when closed, while also ensuring their overlapping when open.

According to this established technique, co-planarity of the door leaves is obtained during closing, although with different devices of greater or lesser complexity, involving, for each door leaf, a step of entrainment, along the respective parallel rails, and a step of pushing for the translational motion thereof into the adjacent bottom rail, the other end of which already supports and guides the other door leaf with which to align the door leaf in movement.

Thus Italian patent no. IT 1,208,152 is known which, in order to achieve co-planarity, uses an entrainment device wherein for each door leaf a pair of sliding guides is provided, by means of adapted brackets and respective sliding elements, such pairs of guides each comprising a rectilinear front guide and a second rear guide with a curved end portion, while the first guide is provided with a part that diverges at right angles and is directed toward the second guide, in order to allow the translational motion of corresponding sliding elements of the corresponding door leaf, by simple translational motion of the door leaf to be moved.

However, even the relative constructional simplicity of the sliding doors solution proposed by the above-mentioned patent has exhibited a complexity in the construction and assembly thereof, as well as a certain encumbrance of the supporting structure and translational motion of the door leaves.

In particular it has been found that the encumbrance of the bracket systems and of the lower trackways leads to failure to use a part of the piece of furniture on which these sliding doors are applied.

A partial solution to the drawbacks ascribable to the cited known art is known from WO 2004/090274 A1, in which a solution is explained for sliding doors for furniture and similar furnishing elements, particularly of the type with two door leaves and of reduced height, having co-planar closure and overlapping opening of the door leaves.

In such a solution the support and translational motion of each slideable door are provided by means of a corresponding bracket arranged on the edge of the outer side, each bracket being associated with a pair of trolleys that can slide, transversely to the door leaf, because they are supported and guided by a respective trolley which, in turn, can slide longitudinally along the edge of the compartment to be closed.

The trolley is guided by a rail and by other containment tracks and is conditioned by an idle roller thereof which is engaged in one of the two longitudinal guides or cams, which are supported and flanked by the supporting rail for sliding, so as to guide one of the two door leaves to overlap the other, when opening, and guide the same door leaf to align itself with the other, stationary door leaf, when closing.

Even though such solution resolves the drawbacks complained of above, it still exhibits some drawbacks, such as a high cost due to the presence of the two trolleys, which are structurally complex. Moreover the use of aluminum profiles for making the base plate for the guides causes the size and weight thereof to increase the overall size and weight of the piece of furniture and increase the production costs.

Moreover the use of the two trolleys determines the presence of friction and play in the various movements, and this can limit the optimization of the movement and the sliding of the door leaf.

Finally, the large number of pieces raises the overall cost of the solution and increases the costs of various maintenance operations.

The aim of the present invention is therefore to resolve the above-mentioned technical problems, eliminating the drawbacks in the cited known art, by providing a device that, applied to sliding doors, makes it possible to achieve the co-planarity of the door leaves thereof, when closed, as well as the possibility of overlapping thereof on both sides of the piece of furniture, when the compartment of the piece of furniture is opened, by means of simple entrainment of each one of the two door leaves, while being simple in terms of construction, easy to maintain and comprising a low number of components.

Within this aim, an object of the invention is to provide a device that, although using wheels, allows an optimal support and movement of the door leaves, such movement being at the same time safe and stable thus preventing the possibility of accidental decouplings.

Another object of the invention is to provide a device that offers contained weight and size and thus low production costs.

Another object of the invention is to make it possible to contain the friction and play in the various movements, thus optimizing the movement and the sliding of the door leaf.

This aim and these and other objects which will become more evident hereinafter are achieved by a device for sliding door leaves with co-planar closure, particularly for furniture, comprising a bracket system for connection to each one of said door leaves and with which a first pair of wheels is associated in a lower region, characterized in that it comprises a second pair of wheels, which, together with said first pair of wheels, are engaged slideably with the head respectively of a first guide and of a second guide, which are T-shaped in cross-section, arc-shaped in plan view, and the stein of which protrudes from the top of said piece of furniture.

Advantageously a third pair of wheels is associated with the bracket system, similarly to said first and second pairs of wheels, and is engaged slideably with said first guide, means adapted to force the closure arrangement of at least one of said door leaves being associated with said third pair of wheels.

Further characteristics and advantages of the invention will become more apparent from the detailed description of a specific, but not exclusive, embodiment, illustrated by way of non-limiting example in the accompanying drawings, wherein.

Figure 1:
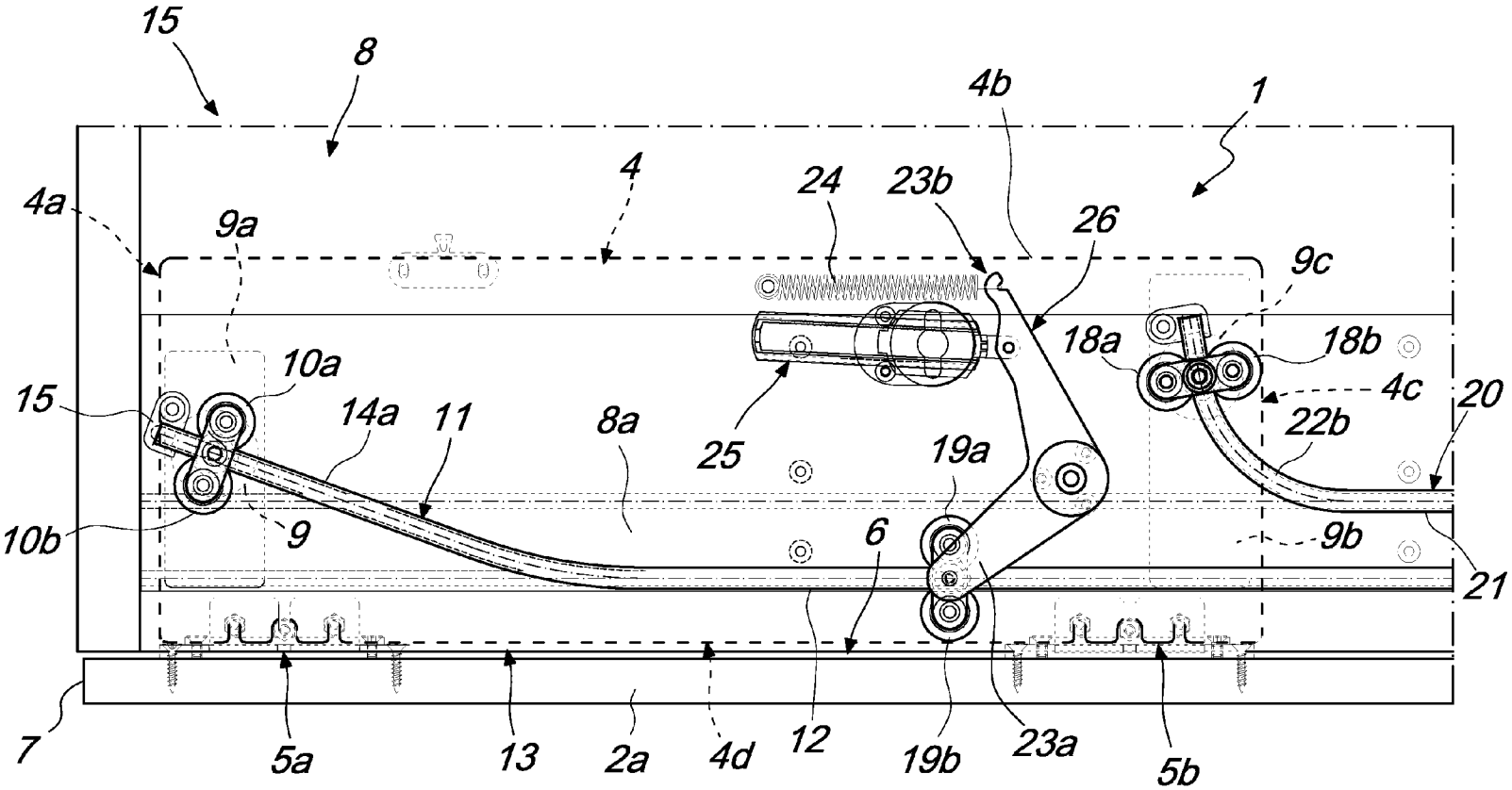
FIG. 1 is a plan view of a first, left-hand half of a piece of furniture with two door leaves with the device applied.
Figure 2:
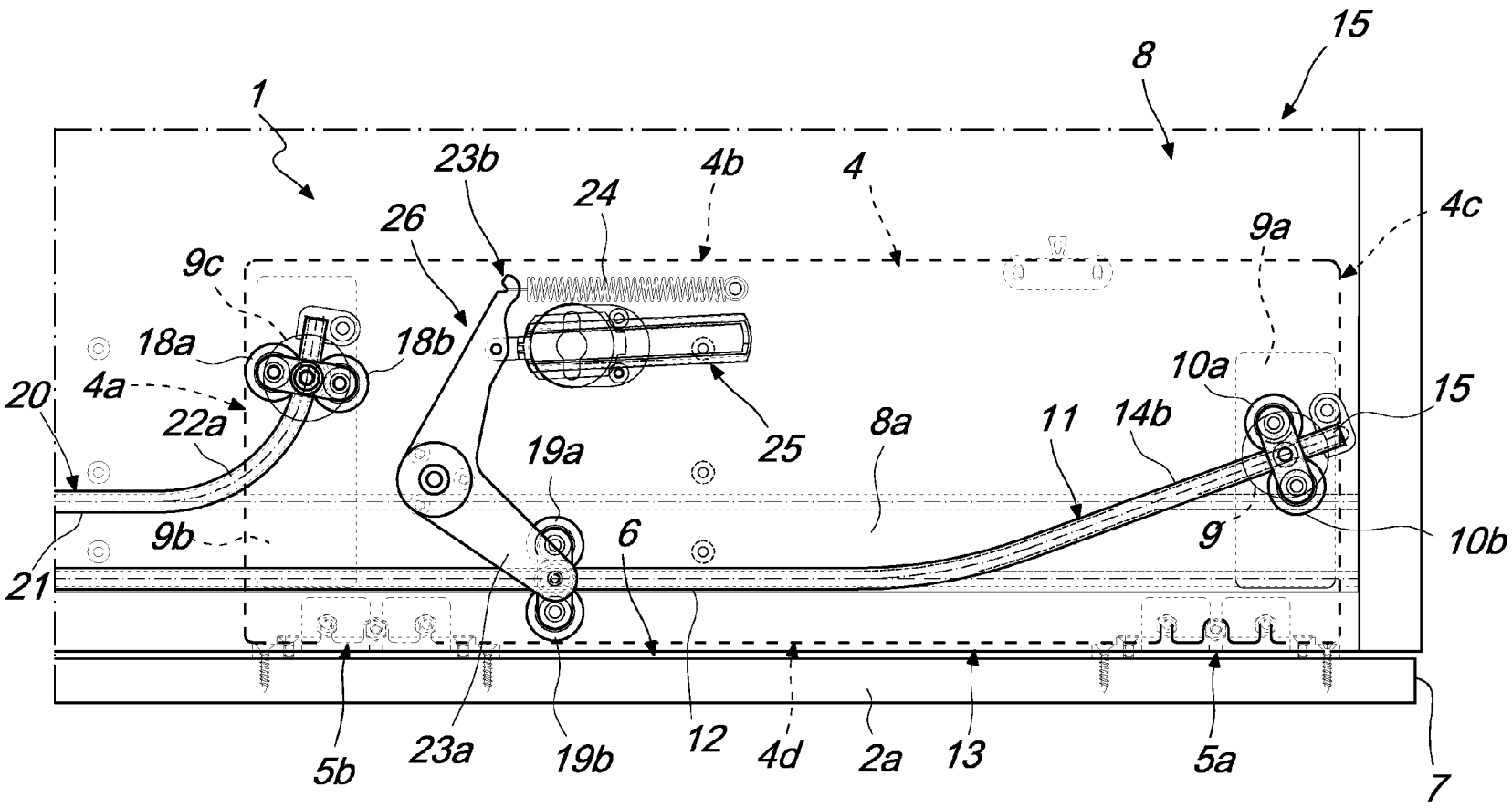
FIG. 2 is a plan view of a second, right-hand half of a piece of furniture with two door leaves with the device applied.
Figure 3:
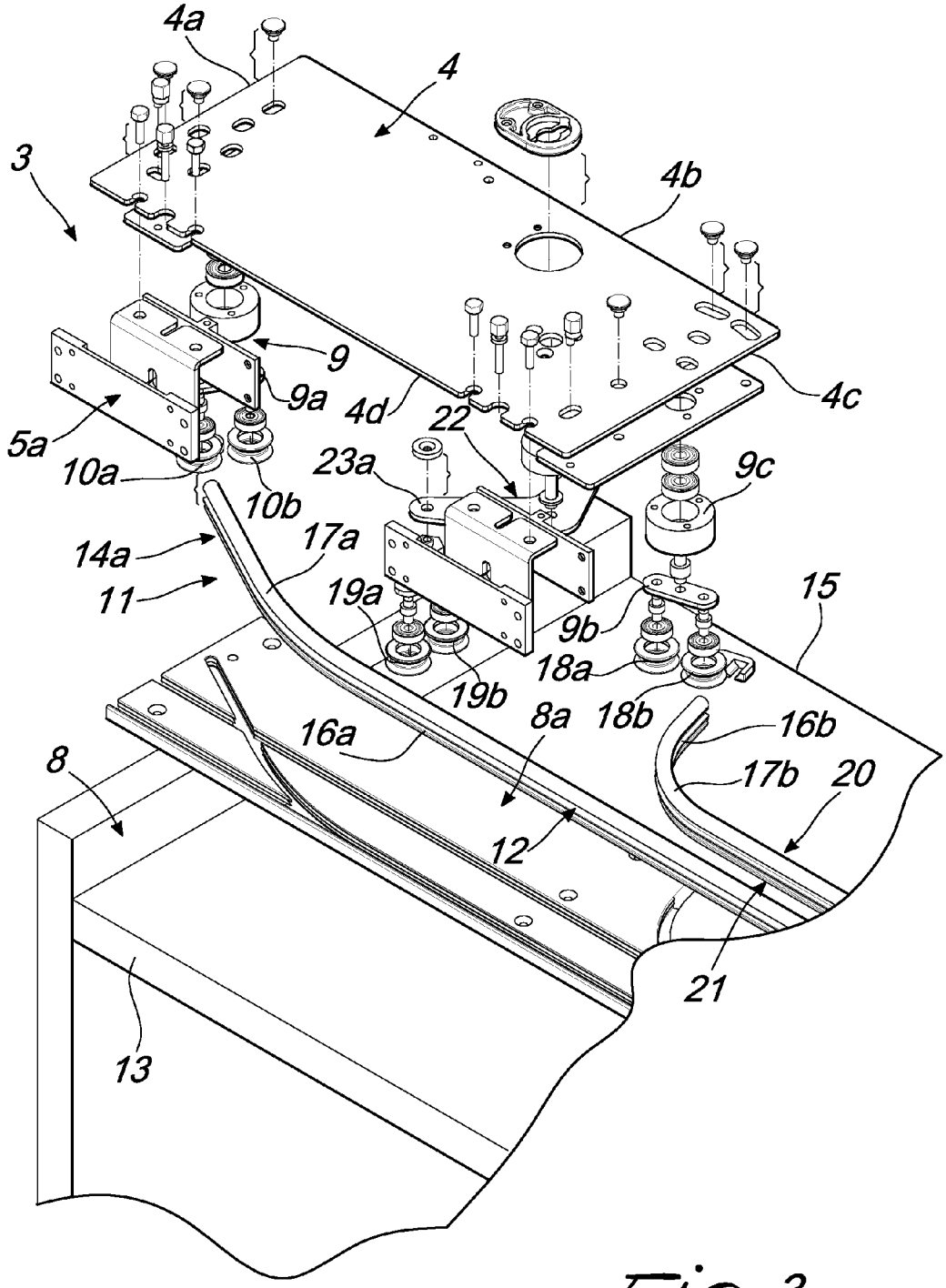
FIG. 3 is a first exploded perspective view of the device.
Figure 4:
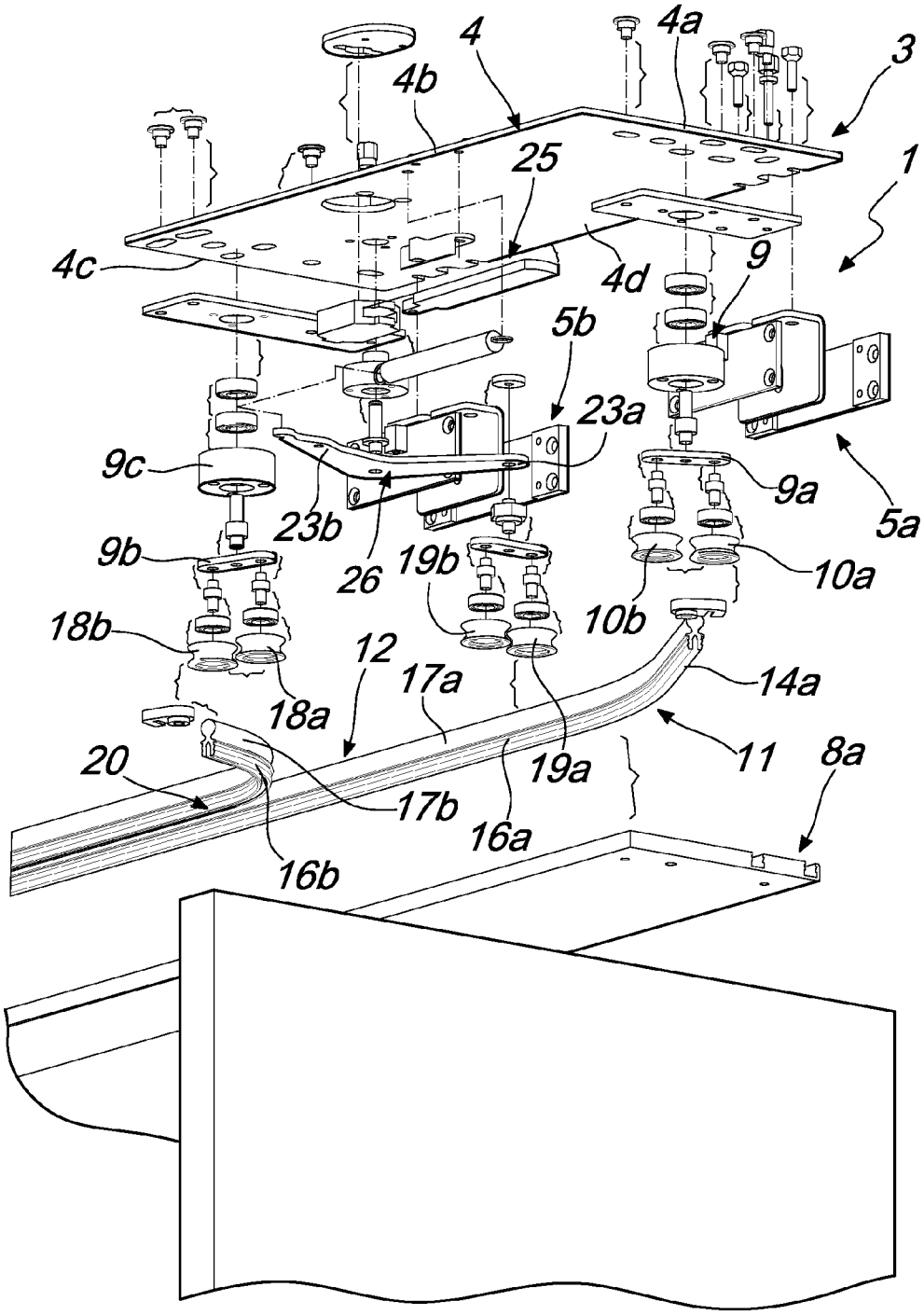
FIG. 4 is a second exploded perspective view of the device.
Figure 5:
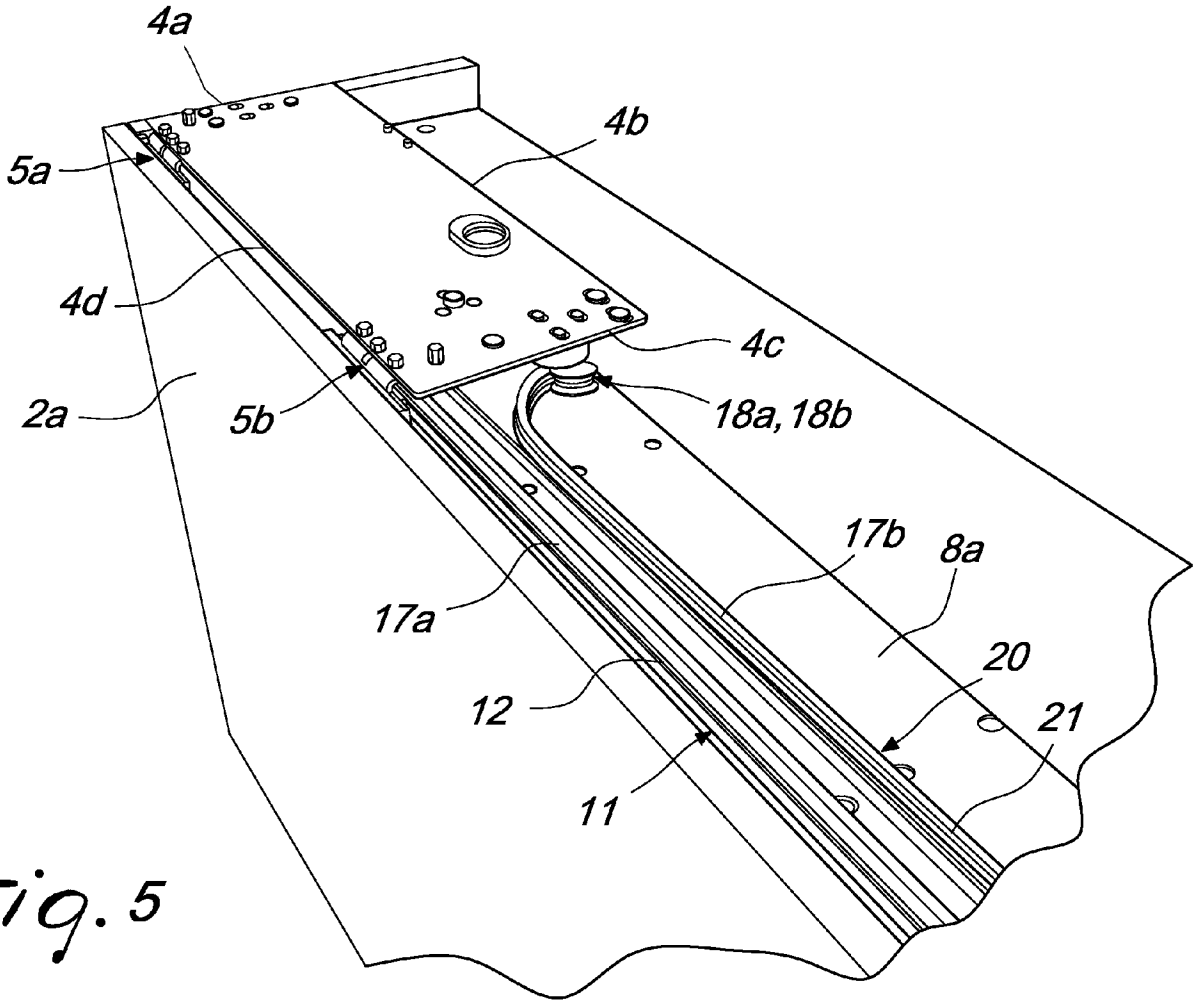
FIG. 5 shows a part of a piece of furniture with the device applied in the condition with the door leaf closed.
Figure 6:
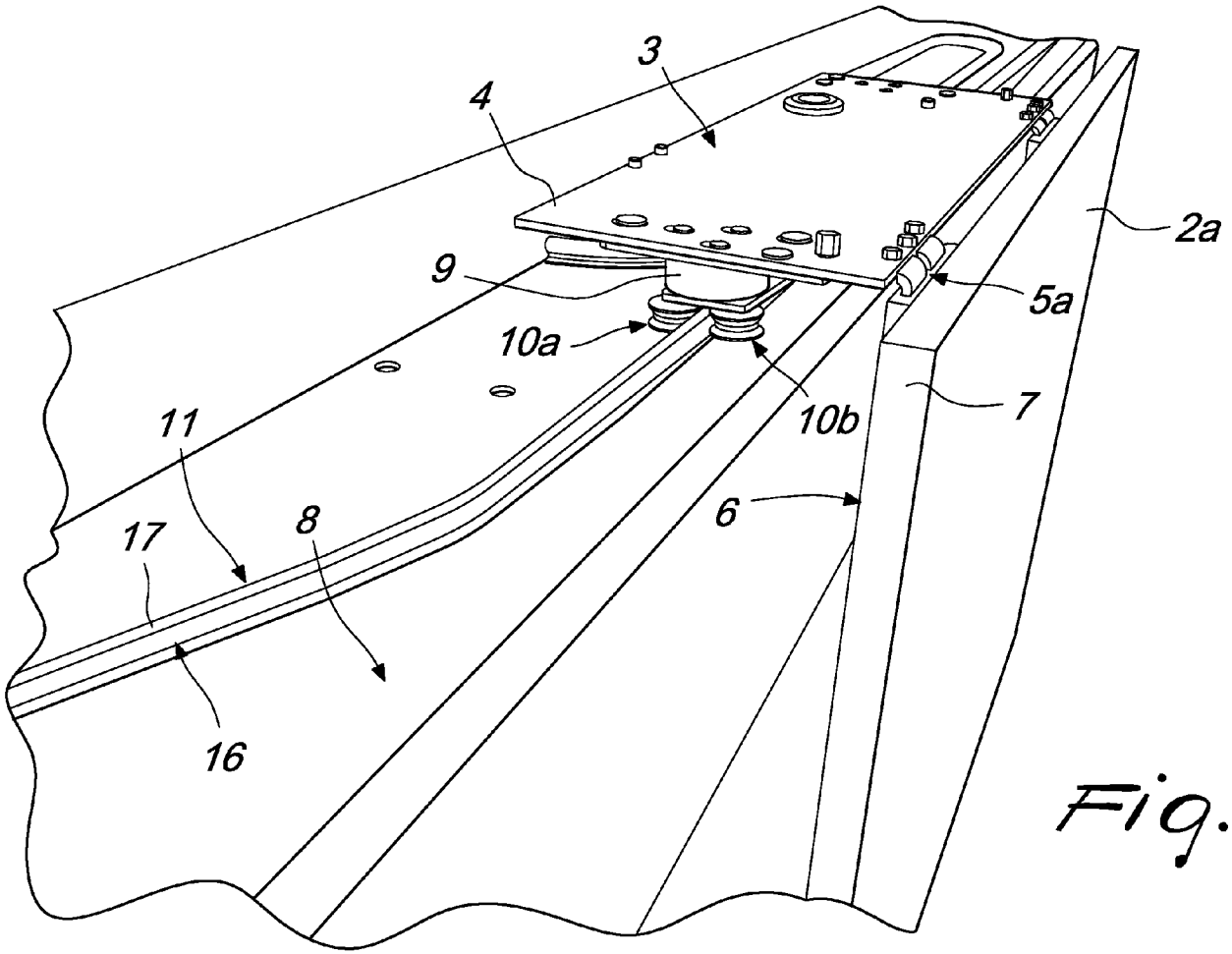
FIG. 6 shows a part of a piece of furniture with the device applied in the condition with the door leaf open.
Figure 7:
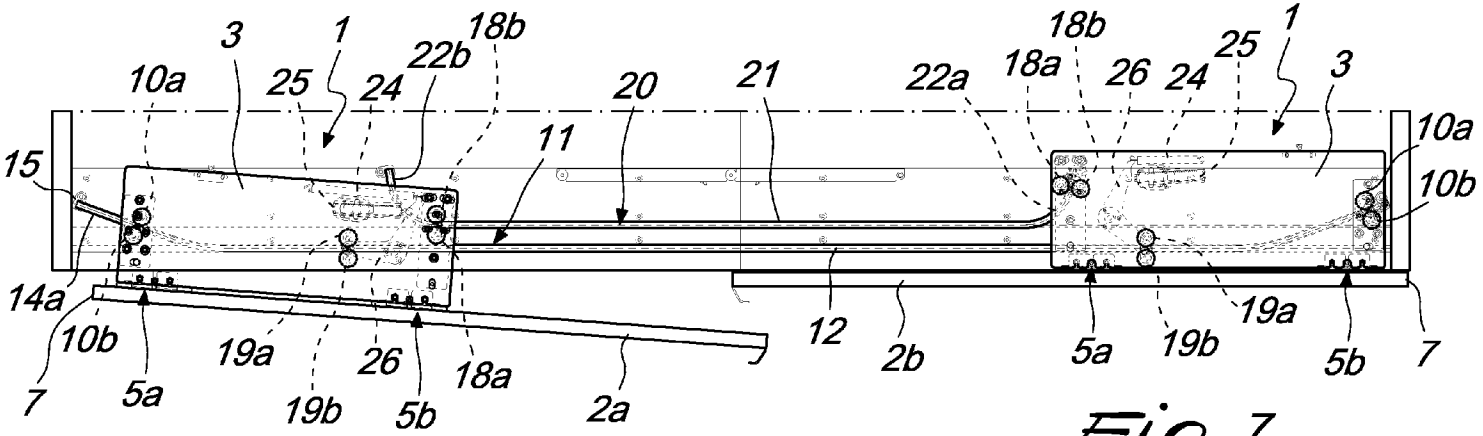
FIGS. 7 and 8 show the invention applied to a piece of furniture in the condition of initial opening of a door leaf and in the condition of a completely open door leaf.
Figure 8:
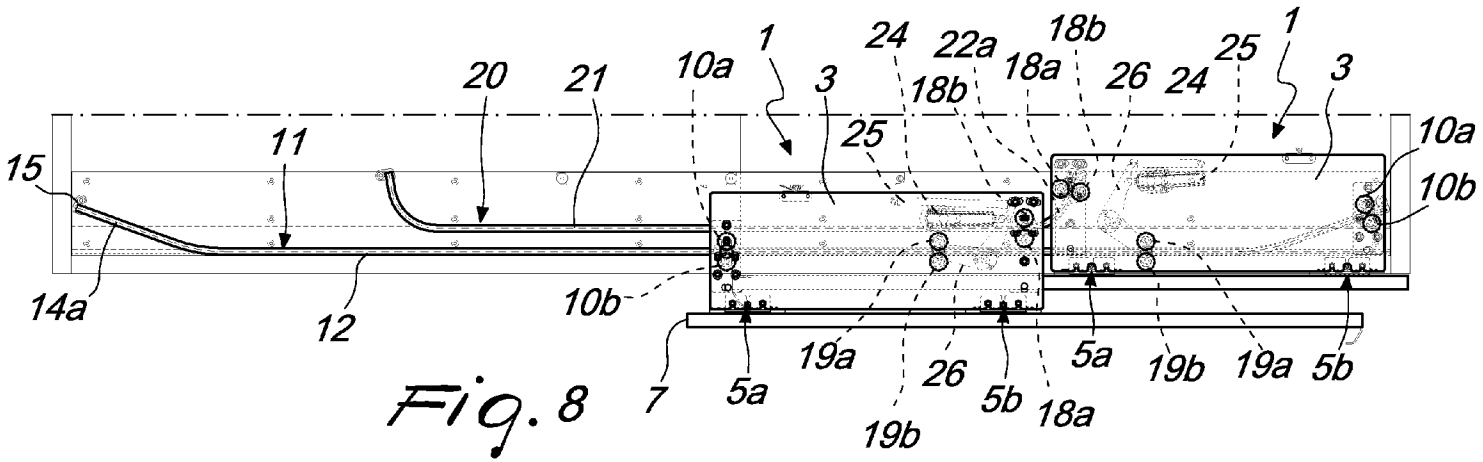

In the embodiments illustrated, individual characteristics shown in relation to specific examples may in reality be interchanged with other, different characteristics, existing in other embodiments.

Moreover, it should be noted that anything found to be already known during the patenting process is understood not to be claimed and to be the subject of a disclaimer.

With reference to the above figures, the reference numeral 1 generally designates a device for sliding door leaves 2*a* and 2*b* with co-planar closure, particularly for furniture and the like.

The device comprises a bracket system 3 for connection with each one of the door leaves 2*a* and 2*b*, composed of a flat plate 4, preferably rectangular in plan view, with which, at one of its longitudinal sides, a pair of L-shaped joints 5*a* and 5*b* are associated the wings of which are connected respectively to the plate 4 and to the inner lateral surface 6 of each door leaf 2*a* and 2*b* at the upper end 7 thereof.

Rotatably associated with the surface of the plate 4 which faces, during use, toward the top 8 of the piece of furniture and is proximate to a central region of the first outer perimetric edge 4*a* of the plate 4, advantageously by way of the interposition of an adapted first cylindrical spacer or hub 9, is a first pair of wheels 10*a* and 10*b*, which are idle and arranged on a same surface parallel to the top 8 and are kept spaced apart by a desired space, which can be fixed or preset.

The rotatable interconnection of the first pair of wheels 10*a* and 10*b* is for example obtained by the use of an arm 9*a* that is pivoted centrally and in a downward region with respect to the first cylindrical spacer or hub 9 and at the ends of which the wheels are in turn pivoted and idle.

Adapted bearings and/or pads are provided in order to reduce friction.

The first pair of wheels 10*a* and 10*b* are slideably engaged with a first guide 11 that protrudes from a base 8*a* which is rendered integral with the top 8 of the piece of furniture, the first guide 11 being thus interposed in the space defined between the first pair of wheels 10*a* and 10*b*.

The first guide 11 is U-shaped, in plan view, so as to define a first portion 12, which is linear and approximately parallel to the front edge 13 of the piece of furniture, and two second portions 14*a* and 14*b* which are inclined toward the rear edge 15 of the piece of furniture and the end of which is adjacent to the lateral edges of the piece of furniture.

The inclination of the second portions 14*a* and 14*b* is such that the distance of the end 15 of the first guide 11 from the front edge 13 of the piece of furniture makes it possible to position the door leaf 2*a* and 2*b*, in the closed condition, right at the front edge 13 of the piece of furniture.

The length of the inclined portion is preferably, but not exclusively, slightly less than half of the length of the plate 4.

The first guide 11 is T-shaped in section so as to define a stein 16*a*, protruding from the base 8*a* associated with the piece of furniture and arranged approximately parallel to the front edge 13 of the piece of furniture, and a head 17*a* which is slideably locked between the grooves of the first pair of wheels 10*a* and 10*b*.

Associated with the bracket system 3 is a second pair of wheels 18*a* and 18*b* and a third pair of wheels 19*a* and 19*b*. The pair of second wheels 18*a* and 18*b* is similar to the first pair of wheels 10*a* and 10*b*.

The rotatable interconnection of the second pair of wheels 18*a* and 18*b* is also for example obtained by the use of an arm 9*b* that is pivoted centrally and in a downward region with respect to a second cylindrical spacer or hub 9*c* and at the ends of which the wheels are in turn pivoted and idle.

The second pair of wheels 18*a* and 18*b* is positioned at the surface of the plate 4 which faces, during use, toward the base 8*a* associated with the top 8 of the piece of furniture and proximate to the longitudinal rear edge 4*b* of the plate 4, in the area of the corner of the plate 4 connecting the longitudinal rear edge 4*b* and the second outer edge 4*c*.

The second pair of wheels 18*a* and 18*b* is slideably engaged with a second guide 20, which is similar in shape to the first guide 11 but is shorter. Such second guide 20 is arranged parallel to the first guide 11 and is positioned in the direction opposite to the front edge (13) of the piece of furniture.

The second guide 20 is also T-shaped in section so as to also define a stein 16*b*, protruding from the base 8*a* associated with the top 8 of the piece of furniture, and arranged approximately parallel to the front edge 13 of the piece of furniture, and a head 17*b* which is slideably locked between the grooves of the second pair of wheels 18*a* and 18*b*.

The distance that extends between the first and the second guide is such as to enable, in the open condition, the desired deviation of the door leaf from the front edge 13 of the piece of furniture.

In particular the shorter length of the second guide is, preferably but not exclusively, approximately equal to double the length of the plate 4 and this second guide 20 is also U-shaped in plan view so as to define a third portion 21 that is linear and approximately parallel to the front edge 13 of the piece of furniture, and two fourth portions 22*a* and 22*b*, which are arc-shaped and directed toward the rear edge 15 of the piece of furniture and shorter than the second portions 14*a* and 14*b*.

The inclination of the fourth portions 22*a* and 22*b* is such that in the condition with the door leaf closed the plate 4 is arranged horizontally and thus parallel to the first and second guides 11 and 20.

The first and second guides 11 and 20 are arranged approximately mirror-symmetrically with respect to a central axis which is transverse to the top 8 of the piece of furniture.

Starting from the condition wherein the door leaves are closed and coplanar, a movement imposed on one of the door leaves in order to achieve the opening thereof involves an initial movement of the plate 4 toward the front edge 13 of the piece of furniture. In particular, the shape of the second guide 20 ensures that the second pair of wheels 18*a* and 18*b*, which support the door leaf thanks to their slideable engagement with the head 17*a* and 17*b*, force the movement of the plate and thus of the door leaf outward from the piece of furniture.

This movement is immediately accentuated thanks to the shape of the fourth portions 22*a* and 22*b*.

The different inclination of the second portions 14*a* and 14*b* of the first guide 11 with respect to the fourth portions of the second guide 20 imposes, in the first step of opening, an initial, inclined arrangement on the plate 4 and thus on the door leaf, until it is brought to the horizontal condition when the first and second pairs of wheels 18*a*, 18*b*, 19*a* and 19*b* are arranged on the first and on the third portion 12 and 21 of the first and of the second guides 11 and 20.

The third pair of wheels 19*a* and 19*b* is positioned at the surface of the plate 4 which faces, during use, toward the base 8*a* associated with the top 8 of the piece of furniture and proximate to the longitudinal front edge 4*d* of the plate 4 which is adjacent to the front edge 13 of the piece of furniture, in an area facing toward the adjacent second outer perimetric edge 4*c* of the plate 4.

The third pair of wheels 19*a* and 19*b* is also arranged on a same surface parallel to the top 8, and the head 17*b* interposed between the wheels is advantageously slideably locked between the grooves of the third pair of wheels 19*a* and 19*b*.

The third pair of wheels 19*a* and 19*b* is rotationally connected with means adapted to force the closure arrangement of at least one of the door leaves.

Such means are constituted by a V-shaped linkage 26, a first end 23*a* of which is pivoted to the third pair of wheels 19*a* and 19*b* and the vertex of which, directed toward the second pair of wheels 18*a* and 18*b*, is pivoted to the plate 4.

The second end 23*b* of the linkage 26 is engaged with an element which can be elastically elongated, such as a spring 24 which at the other end is coupled to the plate 4.

In the condition of a closed door leaf the spring 24 is unloaded.

A unidirectional brake or actuator 25 is engaged, along the same direction as the at least one spring 24, between the vertex and the second end 23*b* of the linkage 26, its function being to work only during closing of the door leaf, so as to slow its stroke during repositioning in a co-planar condition and reduce sudden closing movements.

In practice it has been found that the invention has fully achieved the intended aim and objects, a device having been obtained that, applied to sliding doors, makes it possible to achieve, when closed, the co-planarity of the door leaves as well as, when open, the possibility of overlapping thereof on both sides of the piece of furniture, all of which takes place by means of simple entrainment of each one of the two door leaves, the device being simple in terms of construction, easy to maintain and comprising a low number of components.

The device moreover uses pairs of wheels which, thanks to the interconnection thereof by means of a slideable engagement with the heads of the two T-shaped guides, both makes it possible to support the weight of the door leaves and enables an optimal movement of the door leaves, such movement being at the same time safe and stable thus preventing the possibility of accidental decouplings.

The size and weight of the device are moreover contained and thus it can be made at low cost, the friction and play in the various movements lastly being contained, optimizing the movement and the sliding of the door leaf.

Obviously the materials used as well as the dimensions constituting the individual components of the invention can be more pertinent to specific requirements.

The various means for effecting certain different functions shall not in any way coexist only in the illustrated embodiment, but may be present per se in many embodiments, even if they are not illustrated.

The characteristics indicated as advantageous, convenient or similar may also be missing or be substituted by equivalent characteristics.

The disclosures in Italian Patent Application No. TV2011A000070 from which this application claims priority are incorporated herein by reference.

The invention claimed is:

1. A device including a closure arrangement for sliding door leaves to achieve co-planar closure of said door leaves, the device comprising a bracket system for connection to each one of said door leaves, the bracket system including a first pair of wheels associated in a lower region of the bracket system, a second pair of wheels, which, together with said first pair of wheels, are engaged slideably with a first guide and a second guide, respectively, said guides being T-shaped in cross-section, and having a head that is arc-shaped in cross-section, and a stem of which protruding from a top of a piece of furniture, and a third pair of wheels similar to said first and second pairs of wheels, the third pair of wheels being engaged slideably with said first guide, means adapted to force the closure arrangement of at least one of said door leaves being associated with said third pair of wheels, said third pair of wheels being arranged at a surface of a plate which during use is directed toward a base associated with said top of the piece of furniture and proximate to a longitudinal front edge of said plate which is adjacent to a front edge of the piece of furniture, said third pair of wheels being arranged on a same plane which is parallel to said top of the piece of furniture, said head being interposed between said wheels and being locked slideably between grooves of said third pair of wheels, which are connected rotatably with said means adapted to force the closure arrangement of at least one of said door leaves, said means adapted to force the closure arrangement of at least one of said door leaves being constituted by a V-shaped linkage, a first end of which is pivoted to said third pair of wheels and a vertex of which, directed toward said second pair of wheels, is pivoted to said plate, a second end of said linkage being engaged with an elastically elongatable spring element, which is coupled, at an end, to said plate, said spring element being unloaded in a condition in which the door leaf is closed.

2. The device according to claim 1, wherein said bracket system is composed of a flat plate, which is rectangular and with which two L-shaped joints are associated at a longitudinal side thereof, wings of said joints being connected respectively to said plate and to an internal lateral surface of said door leaves at their upper end, said first pair of wheels being rotatably associated, through the interposition of a first cylindrical spacer or hub, with a surface of said plate that during use is directed toward the top of the piece of furniture and proximate to a central region of a first outer perimetric edge of said plate, said wheels being idle and arranged on a same plane which is parallel to said top and being kept mutually spaced apart from one another by a selected space, which is fixed or can be preset, a rotary interconnection of said first pair of wheels being obtained by using an arm which is pivoted centrally with respect to said first cylindrical spacer or hub and to ends of which said wheels are in turn pivoted and idle.

3. The device according to claim 2, wherein the second pair of wheels and the third pair of wheels are associated with said bracket system, said second pair of wheels being similar to said first pair of wheels and being interconnected rotatably through the use of an arm which is pivoted centrally to a second cylindrical spacer or hub, said second pair of wheels being arranged at a surface of said plate that is directed, during use, toward said base associated with said top of the piece of furniture and proximate to a rear longitudinal edge of said plate, in the region of the corner of said plate for connection between the rear longitudinal edge and a second outer perimetric edge of said plate.

4. The device according to claim 1, wherein said first pair of wheels is engaged slideably with the first guide which protrudes from a base which is jointly connected to said top of said piece of furniture, said first guide being interposed in a space defined between grooves of said first pair of wheels, said first guide being U-shaped so as to define a first portion, which is linear and approximately parallel to a front edge of the piece of furniture, and two second portions, which are inclined toward a rear edge of the piece of furniture and an end of which is adjacent to lateral edges of the piece of furniture.

5. The device according to claim 4, wherein an inclination of said second portions is such that the distance of the end of said first guide from the front edge of the piece of furniture makes it possible to arrange said door leaves, in the closed condition, adjacent to said front edge of the piece of furniture.

6. The device according to claim 4, wherein said first guide is T-shaped in cross-section so as to define the stem, which protrudes from said base which is associated with the piece of furniture and is arranged approximately parallel to said front edge of the piece of furniture, and so as to define the head, which is locked slideably between the grooves of said first pair of wheels.

7. The device according to claim 4, wherein said second pair of wheels is coupled slideably to the second guide, which is similar in shape to said first guide but is shorter, said second guide being arranged parallel to said first guide and being positioned in a direction opposite to said front edge of the piece of furniture, said second guide also being T-shaped in cross-section so as to also define a stem, which protrudes from said base associated with said top of the piece of furniture, which is arranged approximately parallel to said front edge of the piece of furniture, and a head, which is locked slideably between grooves of said second pair of wheels.

8. The device according to claim 7, wherein said second guide is U-shaped so as to define a third linear portion, which is approximately parallel to said front edge of the piece of furniture, and two fourth portions, which are arc-shaped and directed toward said rear edge of the piece of furniture and are shorter than said second portions, an inclination of said fourth portions being such that in a condition in which the door leaf is closed said plate arranges itself horizontally and thus parallel to said first and second guides, which are arranged approximately mirror-symmetrically with respect to a central axis which is transverse to said top of the piece of furniture.

9. The device according to claim 1, wherein a unidirectional brake or actuator is engaged, along a same direction as said spring element, between said vertex and said second end of said linkage to slow a stroke of the door leaf during repositioning in a co-planar condition and reduce sudden closure movements.

* * * * *

UNITED STATES PATENT AND TRADEMARK OFFICE

CERTIFICATE OF CORRECTION

PATENT NO. : 8,984,810 B2
APPLICATION NO. : 14/119119
DATED : March 24, 2015
INVENTOR(S) : Guido Bortoluzzi et al.

It is certified that error appears in the above-identified patent and that said Letters Patent is hereby corrected as shown below:

In the Specification:

Column 2, line 63, replace “stein” with --stem--;

Column 4, line 6, replace “stein” with --stem--; and

Column 4, line 34, replace “stein” with --stem--.

Signed and Sealed this
Seventh Day of July, 2015

Michelle K. Lee

Michelle K. Lee
*Director of the United States Patent and Trademark Office*